US010894581B2

(12) United States Patent
Wong et al.

(10) Patent No.: US 10,894,581 B2
(45) Date of Patent: Jan. 19, 2021

(54) REDUCING TRENCHING AT MOORING LINES

(71) Applicant: ExxonMobil Upstream Research Company, Spring, TX (US)

(72) Inventors: Patrick C. Wong, Cypress, TX (US); Haydar Arslan, Spring, TX (US); Roald T. Lokken, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/541,806

(22) Filed: Aug. 15, 2019

(65) Prior Publication Data

US 2020/0062348 A1 Feb. 27, 2020

Related U.S. Application Data

(60) Provisional application No. 62/720,715, filed on Aug. 21, 2018.

(51) Int. Cl.

| | |
|---|---|
| ***B63B 21/50*** | (2006.01) |
| ***B63B 21/27*** | (2006.01) |
| ***B63B 21/20*** | (2006.01) |
| ***E02D 5/22*** | (2006.01) |
| ***E02D 27/52*** | (2006.01) |
| *E02B 17/00* | (2006.01) |

(52) U.S. Cl.

CPC ..... *B63B 21/20* (2013.01); *B63B 21/27* (2013.01); *B63B 21/50* (2013.01); *E02D 5/226* (2013.01); *E02D 27/525* (2013.01); *B63B 2021/505* (2013.01); *E02B 2017/0078* (2013.01)

(58) Field of Classification Search

CPC . E02B 17/00; E02B 2017/0039; B63B 35/44; B63B 21/24; B63B 21/27; B63B 21/50; B63B 2021/505

USPC ..... 405/224, 224.1, 228; 114/294, 296

See application file for complete search history.

(56) References Cited

U.S. PATENT DOCUMENTS

| | | | | |
|---|---|---|---|---|
| 4,818,146 A * | 4/1989 | Fontenot | E02D 5/80 | 405/212 |
| 5,498,107 A * | 3/1996 | Schatzle, Jr. | E02B 17/00 | 405/195.1 |
| 5,788,417 A * | 8/1998 | Fontenot | B63B 21/50 | 166/368 |
| 6,910,831 B2 * | 6/2005 | Raines | B63B 21/29 | 405/224.1 |
| 7,140,319 B2 * | 11/2006 | Raines | B63B 21/27 | 114/296 |

(Continued)

FOREIGN PATENT DOCUMENTS

| | | |
|---|---|---|
| GB | 2317153 A | 3/1998 |
| KR | 20150055727 A * | 5/2015 |

(Continued)

*Primary Examiner* — Frederick L Lagman

(74) *Attorney, Agent, or Firm* — ExxonMobil Upstream Research Company, Law Depart

(57) ABSTRACT

The present techniques are directed to systems and a method for reducing trenching around piles. An exemplary method includes attaching a mooring line to one end of a padeye extender bar that is coupled by another end to a padeye on the pile. The pile is installed in a sediment layer. The padeye extender bar is deployed to hold an attachment point for the mooring line above the sedimenlt layer.

18 Claims, 13 Drawing Sheets

100

(56) References Cited

U.S. PATENT DOCUMENTS

| | | | | |
|---|---|---|---|---|
| 7,527,455 | B2 * | 5/2009 | Raines | B63B 21/27 405/228 |
| 8,465,229 | B2 | 6/2013 | Maconocie et al. | |
| 8,596,919 | B2 | 12/2013 | Harris | |
| 9,074,447 | B1 * | 7/2015 | Cox | E02D 27/525 |
| 2002/0168233 | A1 | 11/2002 | Bergeron | |
| 2007/0017429 | A1 * | 1/2007 | Riggs | B63B 21/50 114/293 |
| 2009/0123235 | A1 * | 5/2009 | Maconochie | B63B 21/27 405/227 |
| 2011/0002742 | A1 * | 1/2011 | Maconocie | B63B 21/26 405/227 |
| 2015/0218770 | A1 * | 8/2015 | Arslan | E02B 17/0026 405/211 |
| 2015/0275461 | A1 * | 10/2015 | Kwon | E02D 27/52 405/224 |
| 2019/0291824 | A1 * | 9/2019 | Taylor | B63B 21/04 |

FOREIGN PATENT DOCUMENTS

| | | | |
|---|---|---|---|
| WO | 9922983 | A1 | 5/1999 |
| WO | 0056598 | A1 | 9/2000 |
| WO | 2004/079100 | A2 | 9/2004 |
| WO | 2015/119735 | | 8/2015 |

* cited by examiner

100

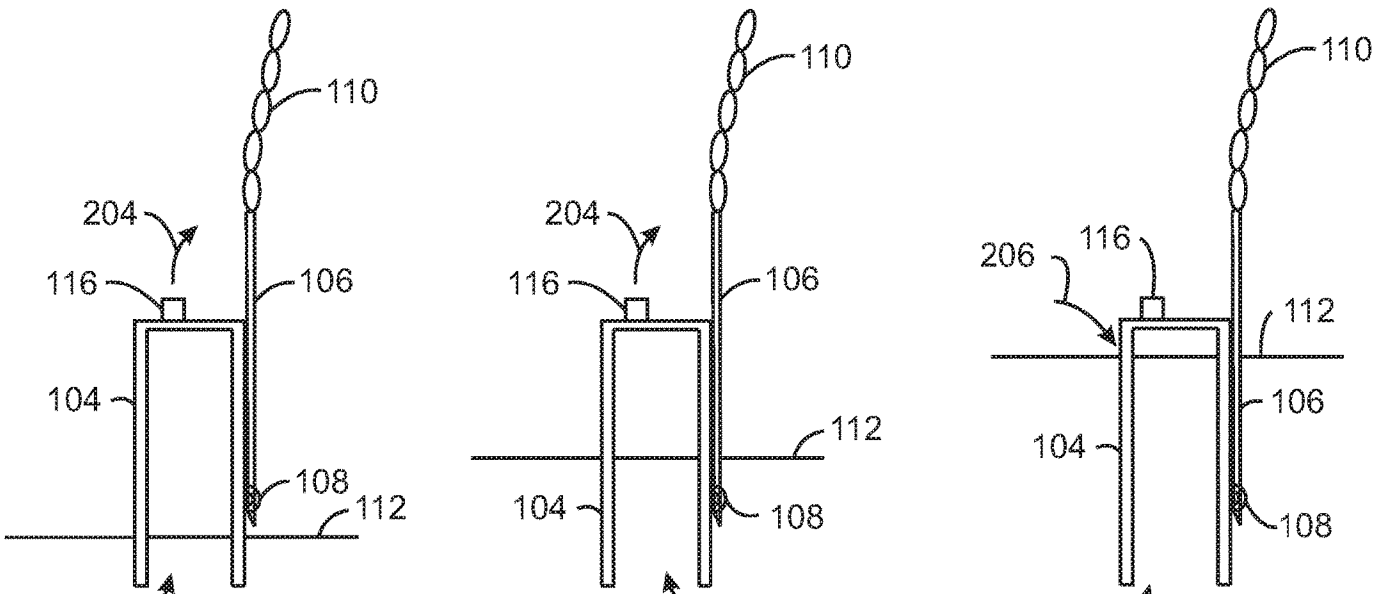
FIG. 2A
FIG. 2B
FIG. 2C
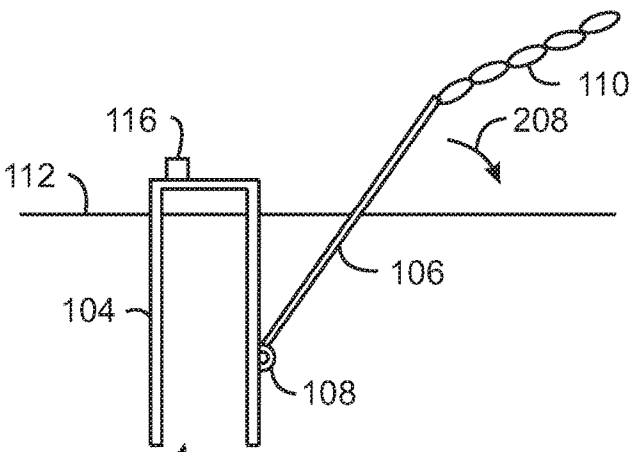
FIG. 2D
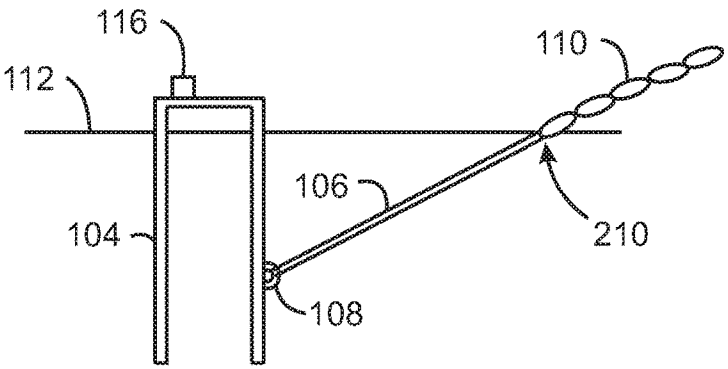
FIG. 2E

500

600

700

800

1200

1300

REDUCING TRENCHING AT MOORING LINES

CROSS REFERENCE TO RELATED APPLICATIONS

This application claims the priority benefit of U.S. Provisional Patent Application No. 62/720,715 filed Aug. 21, 2018, entitled REDUCING TRENCHING AT MOORING LINES.

FIELD

The present disclosure relates generally to a modified pile foundation system for scour protection. More specifically, the present disclosure relates to systems and methods for reducing mooring line trenching by an extension bar extending from the pile foundation.

BACKGROUND

This section is intended to introduce various aspects of the art, which may be associated with exemplary examples of the present techniques. This discussion is believed to assist in providing a framework to facilitate a better understanding of particular aspects of the present techniques. Accordingly, it should be understood that this section should be read in this light, and not necessarily as admissions of prior art.

Pile foundations may be utilized for the support of various structures such as offshore structures, including large offshore platforms, floating production and storage vessels, oil-rigs, and other offshore subsea equipment to safely carry and transfer a structural load to the bearing strata located at some depth below surface of the sediment. In operation, a pile foundation may steady and hold the position of the offshore structure in a harsh environment including rough currents, waves, flood-waters, and any action caused by a vessel-propeller. Today, pile foundation systems are one of the most commonly used anchoring technologies in transferring load through compressible sediments in many deep-water offshore production techniques.

There are various types of piles and many are classified with respect to their load transmission and functional behavior. Types of piles include end bearing piles, settlement reducing piles, tension piles, laterally loaded piles, and friction piles, among others. Friction piles derive their load carrying capacity from the adhesion or friction of the sediment in contact with the shaft of the pile. The load carrying capacity of a friction pile may be partially derived from end bearing and partially from skin friction between the embedded surface of the pile and the surrounding soil. A friction pile may be a driven pile, for example, a solid structure that is pushed into the sediment by force.

Another type of friction pile is a suction pile. A suction pile is a hollow structure that is closed at one end and open at the other. For installation, the open end of the suction pile may be placed in contact with the sediment, and water within the hollow structure may be withdrawn forcing the pile into the sediment. Suction piles are often used in deep water to secure offshore structures, as other types of piles may be difficult to install.

Regardless of the type of pile utilized, the removal and deposition of seafloor sediment, for example, caused by waves and currents, may significantly reduce the holding capacity of the pile. This removal of the seafloor sediment is referred to as scouring. Several types of scouring may be identified with piles supporting offshore structures. One type of scouring may include erosion of the seafloor proximate to the pile due to unidirectional waves and currents. As the water flows around the pile or the pile is struck by forceful waves and currents, the water may change direction and accelerate, sweeping out sediment from around the pile.

Another type of scouring may include the loss of sediment around a pile due to the movement of a mooring line, such as an anchor chain, attached to the pile. The movement of the mooring lines may create trenches that may extend from the original mooring line touchdown point on the seafloor to the mooring pile and are often as deep as the mooring pile padeye, which is the attachment point of the mooring line. In some cases, the trench may extend deeper into the sediment along the pile. The presence of such a trench reduces the capacity of the mooring pile, due to absence of sediment in front of the pile, and may jeopardize the station-keeping capability of the whole mooring system. This may affect the functional basis of the pile located in the sediment and thus the stability of the offshore structure moored to the pile.

Some research in decreasing scouring has focused on the use of structures placed around the pile to reduce scouring. For example, U.S. Pat. No. 8,465,229 to Maconocie et al. discloses an improved system for increasing an anchoring force on a pile. A sleeve is installed over the pile and may be used to provide an additional connecting force to the existing pile. The sleeve may include its own padeye for coupling an anchor line or other coupling member to a structure to be secured. Additionally, the sleeve may include an assembly of rings coupled together with at least one or more longitudinal members.

U.S. Patent Publication No. 2012/0128436 by Harris discloses a disk around a pile in an effort to reduce scouring in close proximity to the pile. The disk has a pile opening through which the pile protrudes and the disk sits on top of the seafloor. The disk may include a peripheral skirt for embedding into the seafloor below the portion of the disk installed above the seafloor. The disk may also include partitions for segmenting chambers of the disk. The chambers may be filled with fluidized fill material, such as grout or concrete to hold the disk in place.

SUMMARY

An embodiment described in examples herein provides a system for reducing trenching. The system includes a pile configured to be disposed in a sediment layer and held in place by friction with the sediment layer. A padeye is mounted to the pile. A padeye extender bar is coupled to the padeye at one end, and attached to a mooring line at an opposite end, wherein the padeye extender bar is configured to support the mooring line above a surface of the sediment layer.

Another embodiment described in examples herein provides a method for reducing trenching around a pile. The method includes attaching a mooring line to one end of a padeye extender bar that is coupled by another end to a padeye on the pile. The pile is installed in a sediment layer. The padeye extender bar is deployed to hold an attachment point for the mooring line above the sediment layer.

Another embodiment described in examples herein provides a system for reducing trenching. The system includes a pile configured to be disposed in a sediment layer and held in place by friction with the sediment layer. A padeye is mounted to the pile. A padeye extender bar is coupled to the padeye at one end, and attached to a mooring line at an opposite end. The padeye extender bar is configured to support the mooring line above a surface of the sediment layer. A support bar padeye is mounted proximate to the upper surface of the pile, and a support bar coupled to the support bar padeye. The support bar is configured to deploy to the padeye extender bar and lock to the padeye extender bar after deployment.

DESCRIPTION OF THE DRAWINGS

The advantages of the present disclosure are better understood by referring to the following detailed description and the attached drawings.

FIGS. 2A-2E are drawings showing the installation of a pile in a sediment layer and the deployment of a padeye extender bar, in accordance with examples.

DETAILED DESCRIPTION

Figure 1:
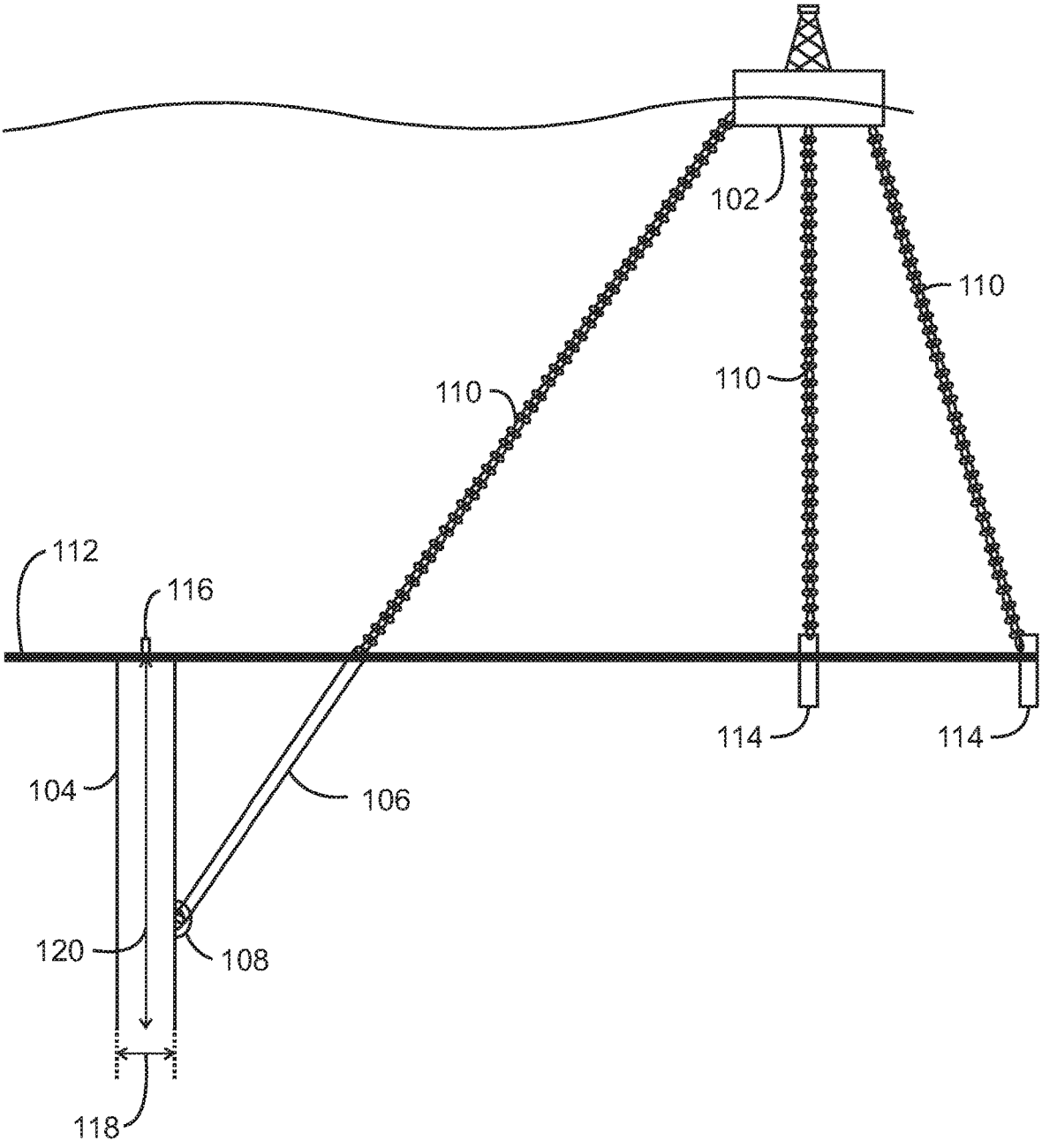
FIG. 1 is a drawing of a pile foundation system holding an offshore structure in place, in accordance with examples.

In the following detailed description section, the specific embodiments of the present disclosure are described in connection with one or more examples. However, to the extent that the following description is specific to a particular embodiment or a particular use of the present disclosure, this is intended to be for exemplary purposes only and simply provides a description of the one or more embodiments. Accordingly, the disclosure is not limited to the specific examples described below, but rather, it includes all alternatives, modifications, and equivalents falling within the true spirit and scope of the appended claims.

Various terms as used herein are defined below. To the extent a term used in a claim is not defined below, it should be given the broadest definition persons in the pertinent art have given that term as reflected in at least one printed publication or issued patent.

Certain terms are used throughout the following description and claims to refer to particular features or components. As one skilled in the art would appreciate, different persons may refer to the same feature or component by different names. This document does not intend to distinguish between components or features that differ in name only. The drawing figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The term "substantially", "substantially the same" or "substantially equal" as used herein unless indicated otherwise means to include variations of a given parameter or condition that one skilled in the pertinent art would understand is within a small degree variation, for example within acceptable manufacturing tolerances.

As used herein, "installation" or "installed" is used to refer to inserting a pile into a sediment layer, for example, using a pile driver or a pump to remove water from the piling. The term "deployment" or "deployed" is used to refer to the final steps to set up the piling after installation, such as moving a padeye extender bar into a final position and locking it into place.

As used herein, "proximate" indicates that an object or effect is near or on another object or effect. For example, a first object that is proximate to a second object, or a location on a second object, is placed near or in contact with the second object or location.

As described herein, a pile provides an attachment point for a mooring line. The pile is installed into a sediment layer and held in place by friction. In some examples, the pile is a suction pile that is pulled into place in the sediment layer as water is removed from the inside of the pile. In other examples, the pile is a driven pile, forced into the sediment layer, for example, by a repetitive hammer force. The pile may be formed from any suitable material, such as concrete or metal. For offshore applications, the materials may include corrosion resistant steel, structural steel, cast-iron, or cast concrete, among others.

The techniques described above may not control scouring from the motion of a mooring line, termed trenching herein. Thus, there remains a need to provide trenching protection to a pile while providing maximum surface area contact between the pile and surrounding soil. Trenching may cause seafloor degradation and erosion around a pile. In some instances, the trenching may be significant, reaching the depth of the padeye that attaches the mooring line to the pile, for example, about two thirds down the side of the pile. Accordingly, the trench formation may impact the functional performance of the pile. As a result, the loads the pile can support may be reduced or, in extreme examples, the pile may become dislodged from the seafloor. This may jeopardize the station-keeping capability of the pile foundation and mooring system.

The present disclosure provide a method and systems for reducing trenching. In one example, a system includes a pile with a padeye extender bar attached to the padeye on the side of the pile, in place of the mooring line. The padeye extender bar may then extend above a sediment layer before attaching to the mooring line. In some examples, the padeye extender bar is locked into place, preventing the padeye extender bar from creating a trench as the mooring line moves.

FIG. 1 is a drawing of a pile foundation system 100 holding an offshore structure 102 in place, in accordance with examples. The pile foundation system 100 includes a pile 104 that uses a padeye extender bar 106 to reduce trenching. The padeye extender bar 106 is coupled to a padeye 108 mounted on the pile 104. In the example of FIG. 1, the offshore structure 102 is moored to the pile 104 through a mooring line 110 that is attached to the padeye extender bar 106 at an opposite end from the attachment to the padeye 108. In various examples, the mooring line 110 is an anchor chain, a woven steel cable, a composite cable, and the like.

The pile 104 is installed into sediment layer 112, such as a seafloor, and the padeye extender bar 106 is deployed. In concert with other piles 114, which may use the same or different technologies, the pile 104 forms a pile foundation that is attached to the offshore structure 102 through mooring lines 110. The pile foundation assists in station-keeping for the offshore structure 102, controlling its movement from wind and water forces. In various examples, the offshore structure 102 is a floating structure as depicted in FIG. 1, or is physically resting on the sediment layer 112 using legs (not shown), which may be embedded in the sediment layer 112. For example, the pile 104 may be used as a temporary or a permanent mooring for offshore structures 102, including floating production, storage and offloading (FPSO) facilities, offloading buoys, tension leg platform (TLP) foundation, well head supports, among other offshore applications. Further, the pile 104 may be used to anchor pipelines and other subsea structures against movement.

As described herein, in an example, the pile 104 is an open-ended structure, or suction pile, that is installed by removing water, or allowing the water to exit, from a port 116. The removal of water from the pile 104, in turn, facilitates the insertion of the pile 104 into the sediment layer 112. A suction pile is often used in deeper waters due to its relative ease of installation and the types of sediment present.

In some examples, the pile 104 is installed into the seafloor, for example, by driving the pile 104 into the sediment layer 112. A driven pile may be adapted to variable site conditions to achieve uniform load carrying capacity with reliability. The use of a driven pile may be advantageous over a suction pile, whose installation may be more sensitive due to various soil types and layering. Additionally, due to the small size of a driven pile relative to a suction pile, a driven pile may be well suited in water depths where existing driving equipment may be used. In either example, the use of the padeye extender bar 106 to bring the attachment point for the mooring line 110 above the surface of the sediment layer 112 may protect the pile 104 from trenching.

As shown in FIG. 1, the pile 104 may have a maximum cross-sectional dimension, $D_p$ 118. The maximum cross-sectional dimension, $D_p$ 118, may be at least about 1.25 to 6 meters in length.

The pile 104 also may have a maximum axial dimension, $L_p$ 120. The $L_p$ 120 may be any suitable dimension that is sufficient to accommodate the anticipated loads on the pile. For example, the ratio of $L_p$ 120 to $D_p$ 118 may be at least about 2, at least about 3.5, at least about 4, or at least about 4.5, for example, in the range of from 2 to 10, or from 3.5 to 8.5. For stiff clays, the ratio may be in the range of from about 3.5 to 4. For intermediate strength clays and other non-clay soils, the ratio may be in the range of from about 4.5 to 7. For soft clays, the ratio may be in the range of from about 7 to 8.5. In some examples, at least about 80% of $L_p$ 120 is disposed beneath the surface of the sediment layer 112, for example at least 90%, at least 95%, at least 99% or 100%.

The pile may have any suitable cross-sectional geometry, for example circular, oval, elliptical, or polygonal such as triangular, square, rectangular, pentagonal, hexagonal, etc. In one or more examples, one or more external surfaces of the pile may have one or more surface features to enhance frictional contact with the soil sediment.

FIGS. 2A-2E are drawings showing the installation of a pile 104 in a sediment layer 112 and the deployment of a padeye extender bar 106, in accordance with examples. Like numbered items are as described with respect to FIG. 1. During the installation, the padeye extender bar 106 is in a substantially vertical, or installation position. This may be controlled by tension from the mooring line 110 holding the padeye extender bar 106 in a near vertical position.

For installation, the open end 202 of the pile 104 is positioned on the surface of the sediment layer 112. A lowering mechanism (not shown) is used to position the pile 104 on the sediment layer 112 and is released and withdrawn. The pile 104 may initially penetrate the sediment layer 112 level due to the weight of the pile, for example, as shown in FIG. 2A.

As shown in FIGS. 2A and 2B, the water 204 contained within the cylinder of the pile 104 above the sediment layer 112 may be pumped out through a port 116. This may create a suction force that may force the additional length of the pile 104 to embed itself into the sediment layer 112 to a target penetration. The target penetration may be achieved, for example, when the top of the pile 104 is within a target distance 206 of the surface of the sediment layer 112, as shown in FIG. 2C. In various examples, the target distance 206 may be substantially level with the surface of the sediment layer 112, or within 5 cm, 10 cm, 50 cm, or a meter, among others. The insertion depth of the pile 104 may depend on the length of the pile.

As shown in FIG. 2D, once the pile 104 is in place in the sediment layer 112, the padeye extender bar 106 may be deployed by being rotated 208 away from the pile 104. In an example, this is performed by pulling the mooring line 110. Although this may cut an initial trench in the sediment layer 112, for example, corresponding to the width of the padeye extender bar 106, the sediment layer 112 may reform over the padeye extender bar 106.

As shown in FIG. 2E, when fully deployed, the padeye extender bar 106 may be locked in an operational position, for example, wherein the attachment end 210 of the padeye extender bar 106 attaches to the mooring line 110 at or above the surface of the sediment layer 112. A locking mechanism, for example, as described with respect to the example of FIG. 6, may be used to lock the padeye extender bar 106 in a fixed position. Accordingly, as the mooring line 110 moves with the offshore structure 102 (FIG. 1), trench formation due to the motion of the mooring line 110 may be reduced or prevented.

Reinforcement may be provided to hold the padeye extender bar 106 in place, lowering stress on the padeye 108. This is discussed further with respect to FIGS. 3A-3C.

Figures 3A, 3B, 3C:
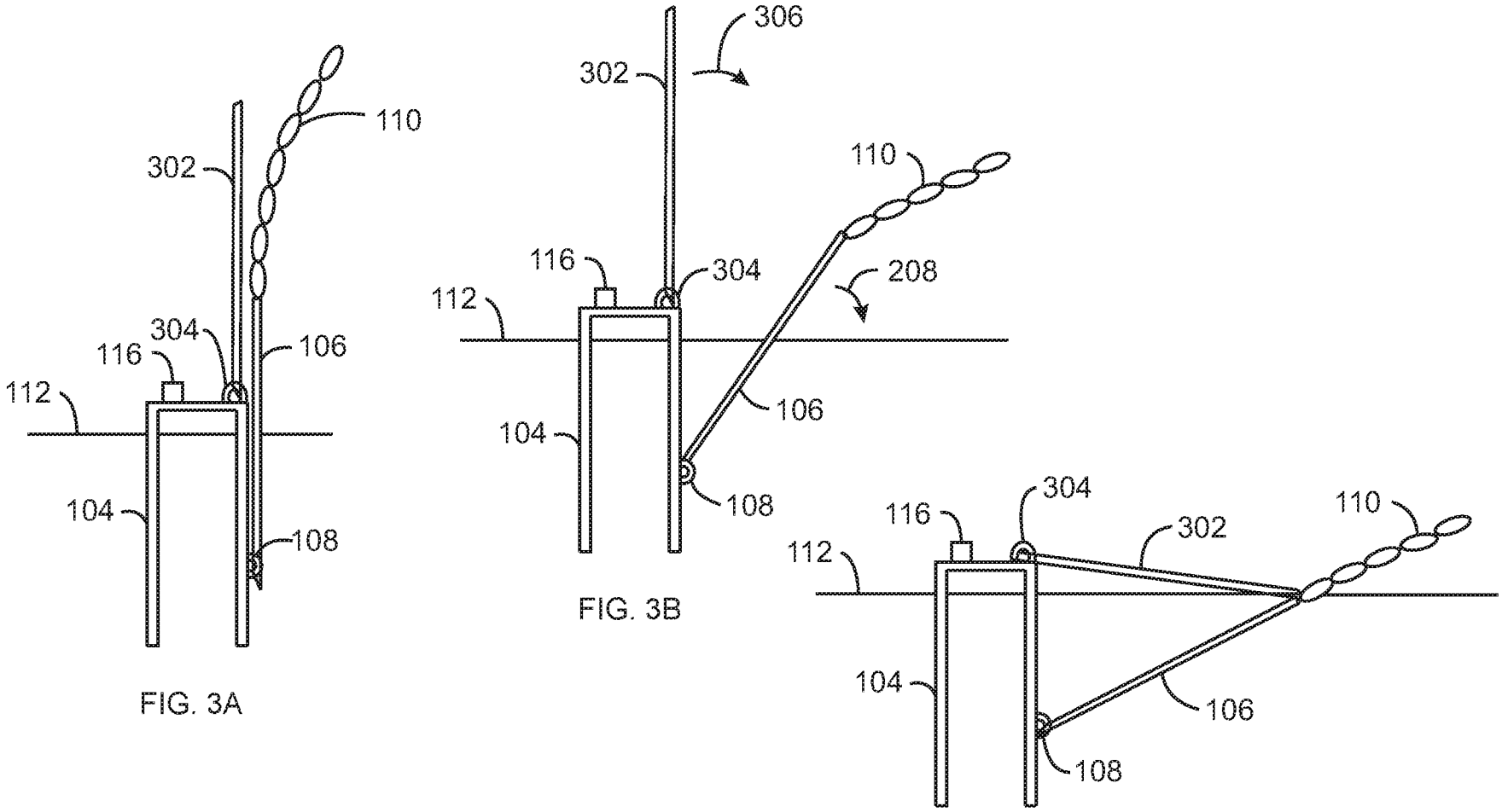
FIGS. 3A-3C are drawings of a pile using a padeye extender bar and a support bar, in accordance with examples.

FIGS. 3A-3C are drawings of a pile 104 using a padeye extender bar 106 and a support bar 302, in accordance with examples. Like numbered items are as described with respect to the previous figures. The support bar 302 attaches to a support bar padeye 304 proximate to, for example, mounted on or near, the top surface of the pile 104. The support bar padeye 304 may be located directly on the top surface as shown in FIGS. 3A-3C, or may be located proximate to the top of the pile 104 on the side surface of the pile 104.

In FIG. 3A, the padeye extender bar 106 and the support bar 302 are held in a substantially vertical position for installation of the pile 104. For example, the support bar 302 may be locked into a vertical position using the mechanism described with respect to FIG. 7. The installation process is similar to that described with respect to FIGS. 2A and 2B, wherein water is pumped out of a port 116 located on the top surface of the pile 104 to pull the pile 104 into the sediment layer 112. In other examples, the pile 104 is enclosed, or solid, and is driven into the sediment layer 112.

As shown in FIG. 3B, after installation of the pile 104 is completed, the padeye extender bar 106 is deployed. This may be performed by rotating 208 the padeye extender bar into the operational position. During the deployment of the padeye extender bar 106, the support bar 302 may remain in the vertical position. Once the padeye extender bar 106 is deployed, the support bar 302 may be deployed by unlocking the support bar 302, if locked, and rotating 306 the support bar 302 into the deployed position. In various examples, this is performed by the techniques described with respect to FIG. 6. However, other techniques may be used to lock the support bar 302 to the padeye extender bar 106.

As shown in FIG. 3C, in the deployed position the support bar 302 contacts the padeye extender bar 106, for example, at the end of the padeye extender bar 106 that is attached to the mooring line 110. In some examples, the support bar 302 may be locked to the padeye extender bar 106. The locking of the support bar 302 to the padeye extender bar 106 may be performed by the mechanisms described with respect to FIG. 8, 10, or 12, among others.

Figures 4A, 4B, 4C:
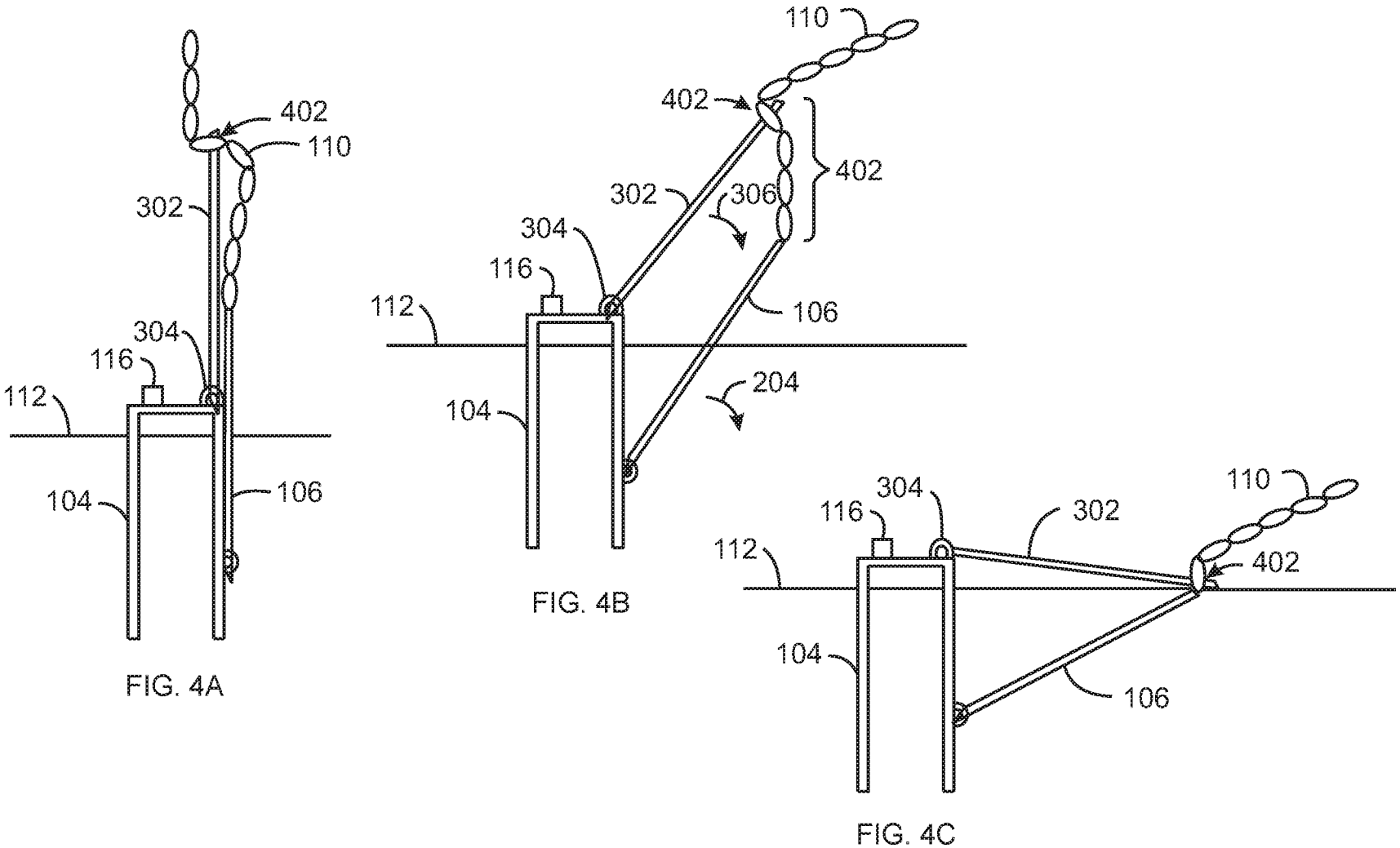
FIGS. 4A-4C are drawings of a pile using a padeye extender bar and a support bar, wherein a mooring line holds both the padeye extender bar and the support bar in an upright position until final installation, in accordance with examples.

FIGS. 4A-4C are drawings of a pile 104 using a padeye extender bar 106 and a support bar 302, wherein a mooring line 110 holds both the padeye extender bar 106 and the support bar 302 in an upright position until deployment, in accordance with examples. Like numbered items are as described with respect to previous figures. In this example, the mooring line 110 passes through an opening 402 on the end of the support bar 302 that is opposite to the end that couples to the support bar padeye 304.

As shown in FIG. 4A, the mooring line 110 may be used to hold both the padeye extender bar 106 and the support bar 302 in a vertical position during installation. As shown in FIG. 4B, the deployment of the padeye extender bar 106 also deploys the support bar 302 by rotating 306 the support bar 302 into the deployed position, which is linked to the padeye extender bar 106 through a segment of the mooring line 110. In an example, the deployment of both may performed by pulling the mooring line 110.

As shown in FIG. 4C, after deployment the support bar 302 may be locked to the padeye extender bar 106. In some examples described herein, the mooring line 110 is decoupled from the support bar 302 during the final deployment and the support bar 302 is directly latched to the padeye extender bar 106. One example of this is described further with respect to FIGS. 9 and 10.

Figure 5:
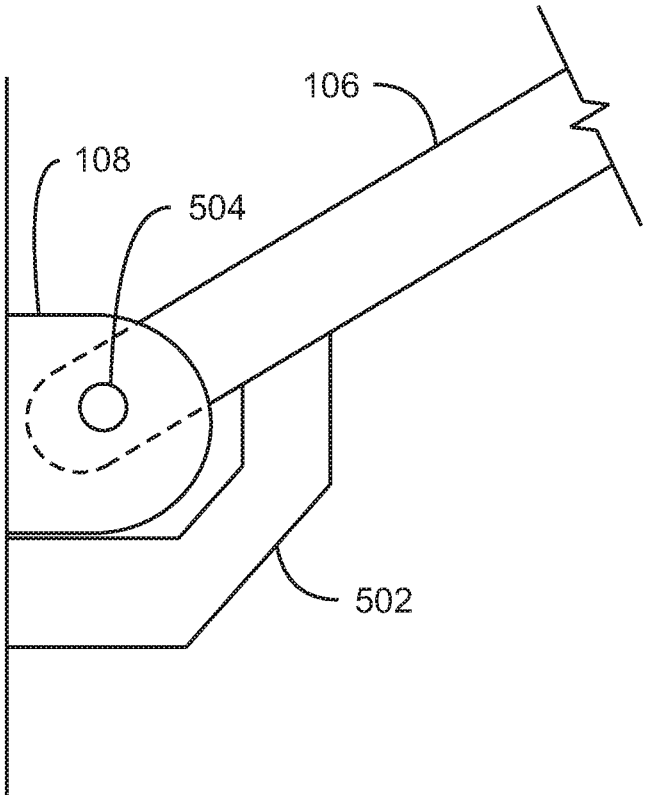
FIG. 5 is a drawing of a padeye and a stop to hold the padeye extender bar in position after deployment, in accordance with examples.

FIG. 5 is a drawing 500 of a padeye 108 and a stop 502 to hold the padeye extender bar 106 in position after deployment, in accordance with examples. Like numbered items are as described with respect to previous figures. As the padeye extender bar 106 rotates into the operational position, the stop 502 may be used to prevent the padeye extender bar 106 from rotating past the operational position. The padeye extender bar 106 may rotate on a pivot pin 504 that is part of the padeye 108.

In some examples, the stop 502 is configured to slide into an opening on the padeye extender bar 106. A locking pin may then be inserted into aligned holes on the stop 502 and the padeye extender bar 106 to lock the padeye extender bar 106 in place. Other mechanisms, such as described with respect to FIG. 6, may be used to lock the padeye extender bar 106 in the operational position.

Figure 6:
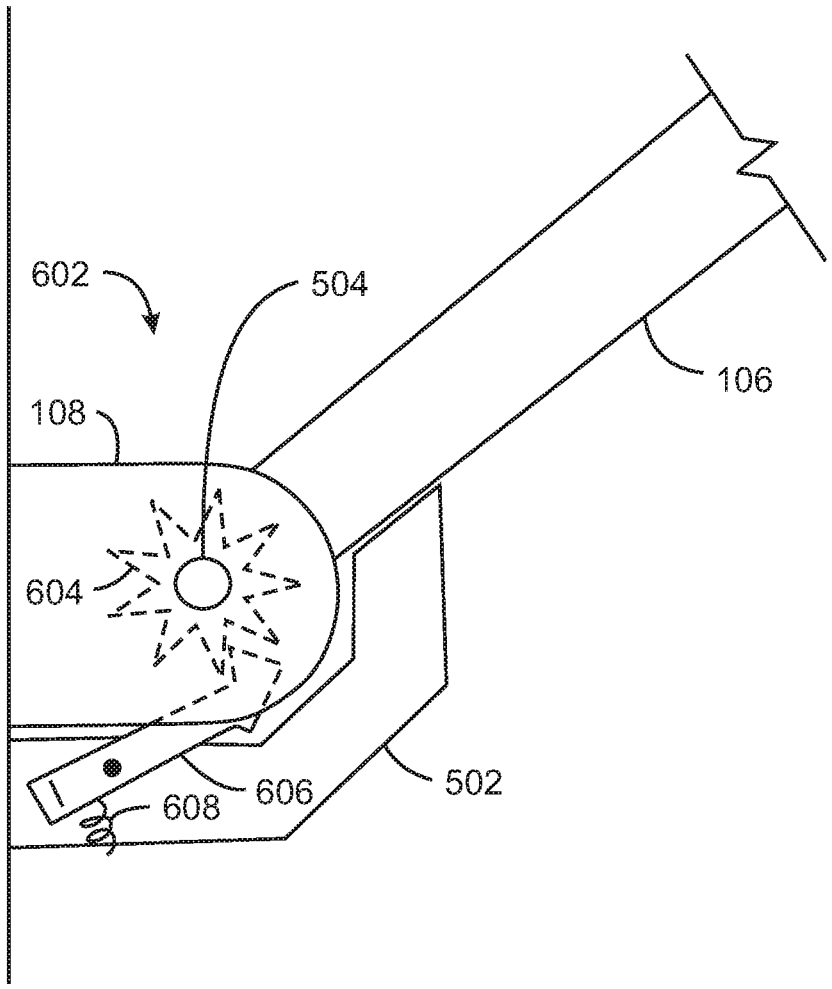
FIG. 6 is a drawing of a padeye using a locking mechanism to hold the padeye extender bar in position after deployment, in accordance with examples.

FIG. 6 is a drawing 600 of a padeye 108 using a locking mechanism 602 to lock the padeye extender bar 106 in the operational position after deployment, in accordance with examples. In this example, the locking mechanism is a ratchet mechanism. The ratchet mechanism includes a gear 604 that is coupled to the pivot pin 504. A pawl 606 meshes with the teeth of the gear 604, and is held in place against the gear 604 by a spring 608. As the padeye extender bar 106 rotates into place, the pawl 606 holds the gear 604 from turning backwards, preventing backwards movement of the padeye extender bar 106. Along with the stop 502, the locking mechanism 602 locks the padeye extender bar 106 in the deployed position, inhibiting trenching from motion of the padeye extender bar 106 that may be caused by movement of the mooring line 110.

Figure 7:
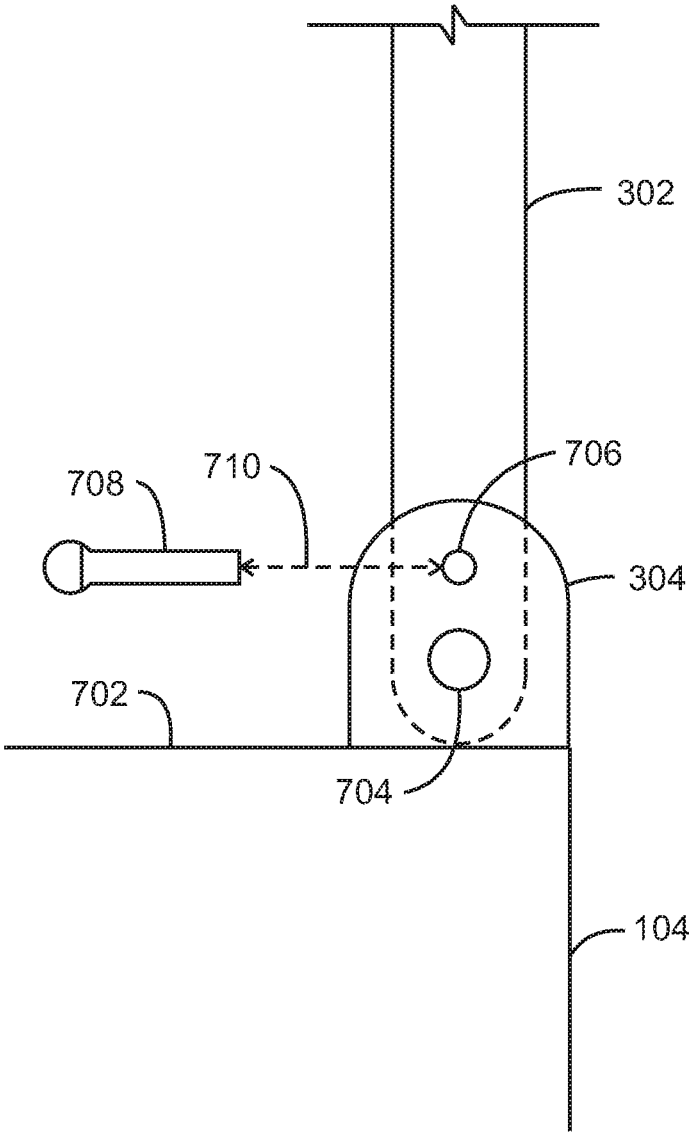
FIG. 7 is a drawing of a locking mechanism to hold a support bar in a vertical position during deployment, in accordance with examples.

FIG. 7 is a drawing of a locking mechanism 700 to hold a support bar 302 in a vertical position during installation, in accordance with examples. Like numbered items are as described with respect to previous figures. As described herein, the support bar 302 is coupled to a support bar padeye 304. In some examples, the support bar padeye 304 is located on a top surface 702 of a pile 104. In one example, the support bar 302 rotates around a hinge pin 704 in the support bar padeye 304.

In this example, the support bar padeye 304 and the support bar 302 have deployment holes 706 that are aligned when the support bar 302 is in a vertical position. A deployment pin 708 is inserted 710 to hold the support bar 302 in a vertical position during installation. After installation, the deployment pin 708 is removed 710 from the aligned deployment holes 706 to allow the support bar 302 to be deployed into the operational position. The removal of the deployment pin 708 may be performed by a remotely operated vehicle (ROV), or by other techniques, such as divers.

Figure 8:
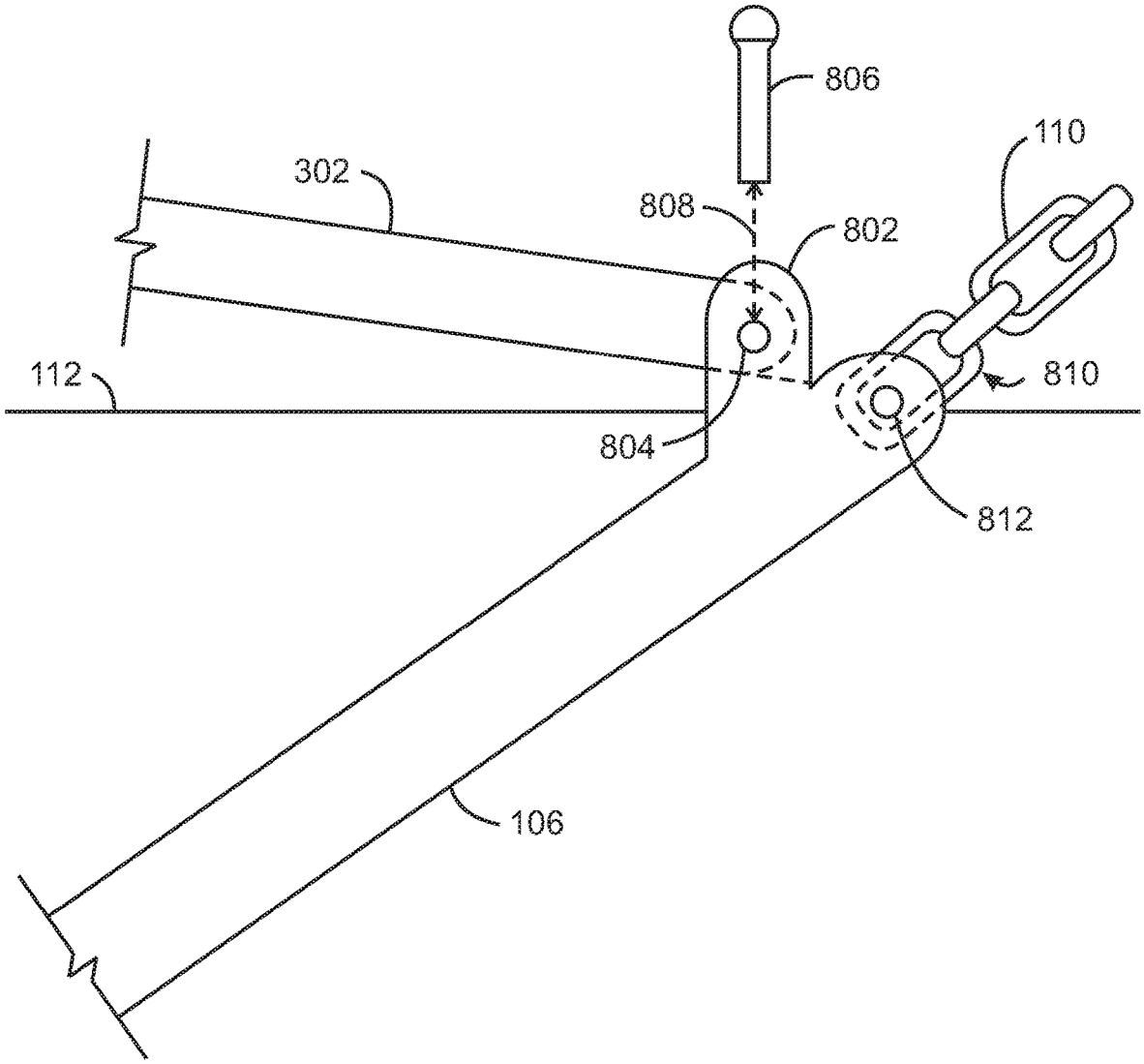
FIG. 8 is a drawing of a locking mechanism to secure a padeye extender bar to a support bar in a deployed position, in accordance with examples.

FIG. 8 is a drawing of a locking mechanism 800 secure a padeye extender bar 106 to a support bar 302, in accordance with examples. In this example, the support bar 302 mates to a tab 802 on the padeye extender bar 106, for example, with a narrow region on the support bar 302 configured to slide into a slot formed into the tab 802. The tab 802 and the support bar 302 may have locking holes 804 that are aligned after deployment. A locking pin 806 is inserted 808 through the aligned locking holes 804. The support bar 302 may then prevent motion of the padeye extender bar 106. Further, the support bar 302 increases the strength of the attachment of the mooring line 110 to the pile 104, for example, providing two attachment points to the pile 104.

FIG. 8 also illustrates the attachment of a mooring line 110 to the padeye extender bar 106. In this example, the mooring line 110 is an anchor chain having a terminal link 810 engaged with the end of the padeye extender bar 106, for example, with the terminal link 810 sliding into a forked section of the padeye extender bar 106. A mooring line pin 812 may then lock the terminal link 810 into the padeye extender bar 106. Other techniques may be used to join the mooring line 110 to the padeye extender bar 106, including welding the mooring line 110 to the padeye extender bar 106, or clamping the mooring line 110 to the padeye extender bar 106, among others.

Figure 9:
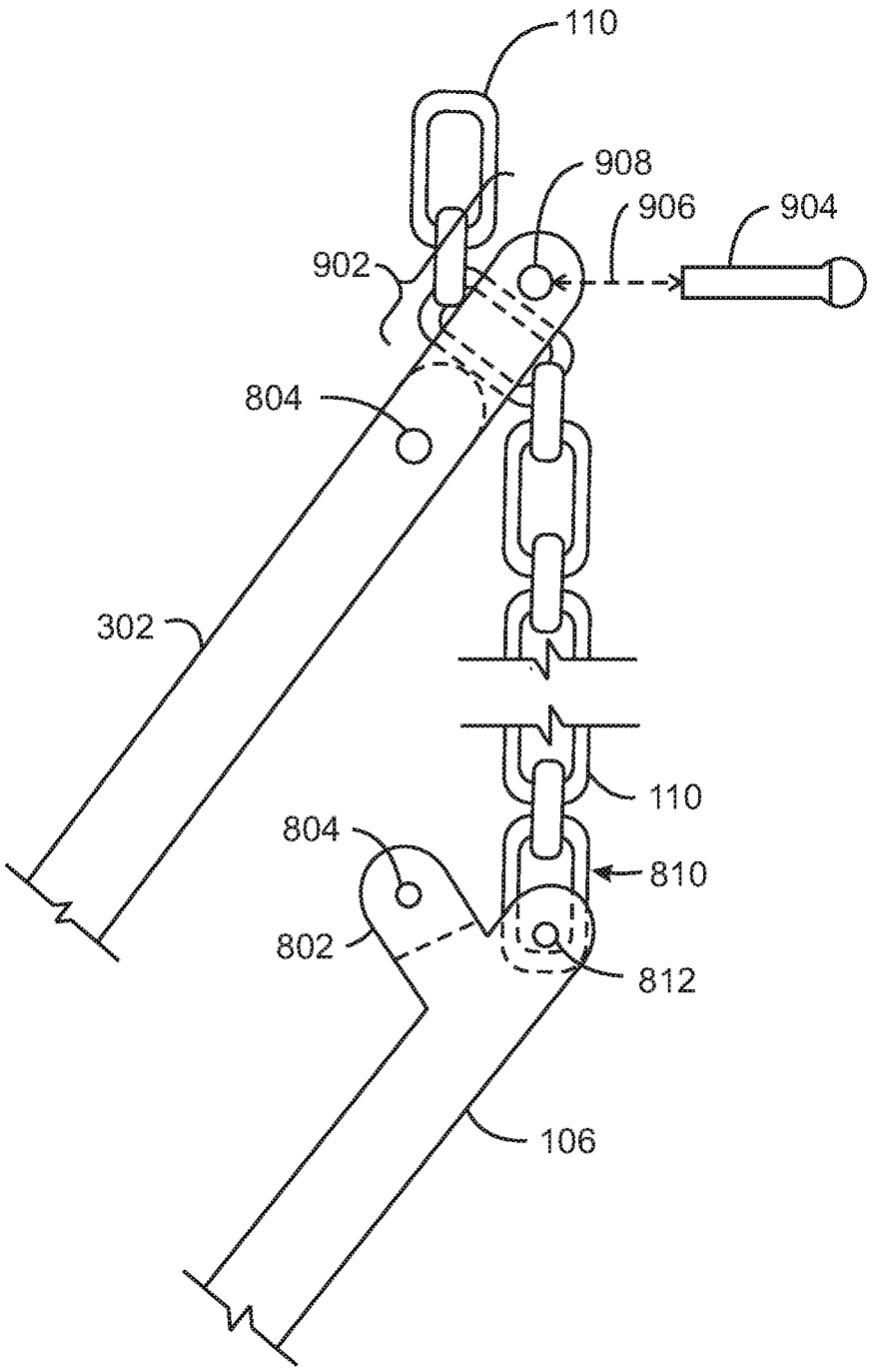
FIG. 9 is a drawing of a support bar and a padeye extender bar in an intermediate position during deployment, wherein the mooring line locks to the top of the support bar during deployment, in accordance with examples.

FIG. 9 is a drawing of a support bar and a padeye extender bar in an intermediate position during deployment, wherein the mooring line locks to the top of the support bar during deployment, in accordance with examples. Like numbered items are as described with respect to previous figures. This example illustrates a technique wherein the mooring line 110 may be used to hold both the support bar 302 and the padeye extender bar 106 in a vertical position during deployment, as described with respect to FIG. 4A.

In this example, the mooring line 110 is joined to an end of the support bar 302, for example, by having a portion, or a link, of the mooring line 110 held in a forked region 902 of the support bar 302 by a chain pin 904 that is inserted 906 into a hole 908 at an outside end of the forked region 902. After installation, the chain pin 904 may be removed 906 from the hole 908, allowing the mooring line 110 to be removed from the forked region 902 for deployment. This allows the support bar 302 to come into contact with the padeye extender bar 106, as discussed further with respect to FIG. 10.

Figure 10:
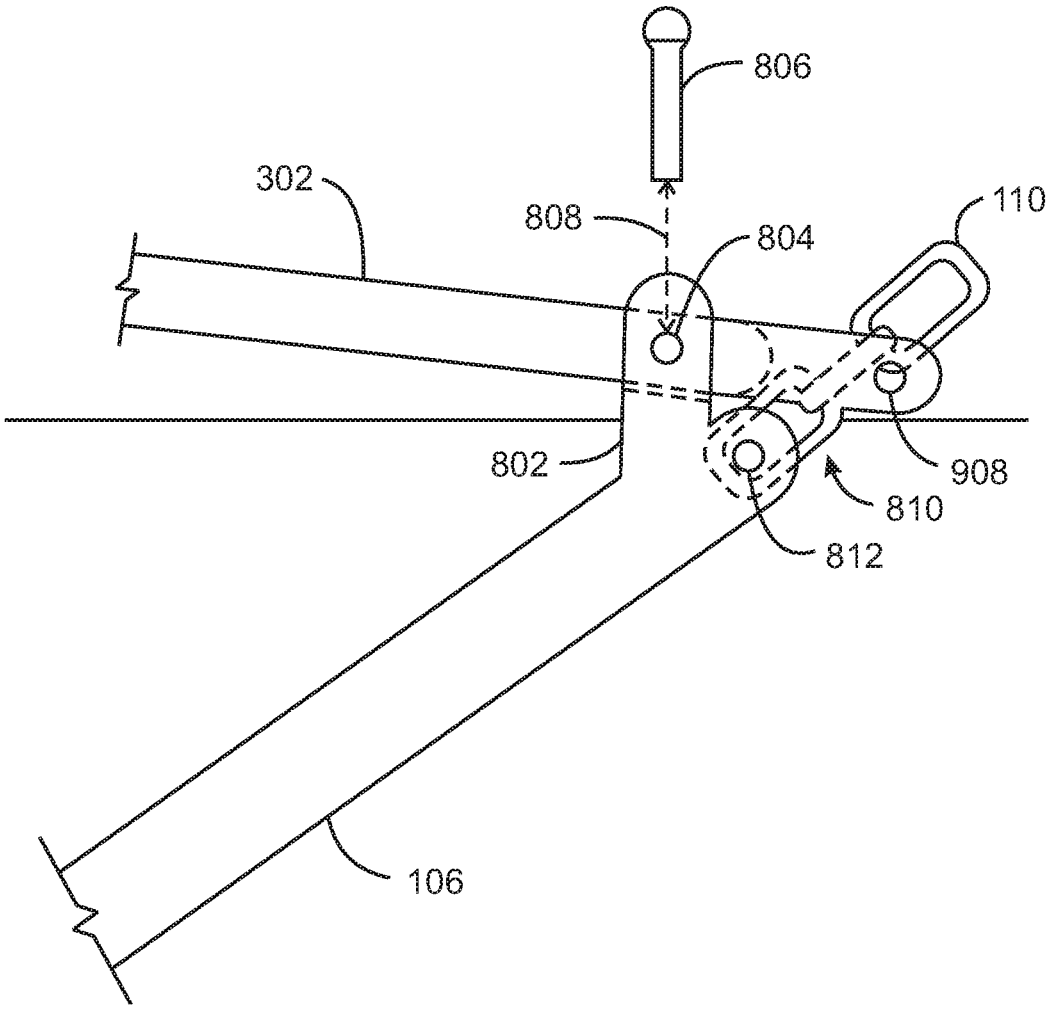
FIG. 10 is a drawing of the support bar and a padeye extender bar in a deployed position, in accordance with examples.

FIG. 10 is a drawing of the support bar 302 and a padeye extender bar 106 in a deployed position, in accordance with examples. Like numbered items are as described with respect to previous figures. In this example, a tab 802 on the padeye extender bar 106 and a narrow region on the support bar 302 include locking holes 804 that are aligned when the support bar 302 and the padeye extender bar 106 are in the deployed position. As described with respect to FIG. 8, a locking pin 806 may then be inserted 808 into the aligned locking holes 804 to hold the support bar 302 and the padeye extender bar 106 together in the deployed position. In some examples, the forked region 902 (as illustrated in FIG. 9) of the support bar 302 is used to hold the mooring line 110 during installation, and then lock to the padeye extender bar 106, after deployment.

Figure 11:
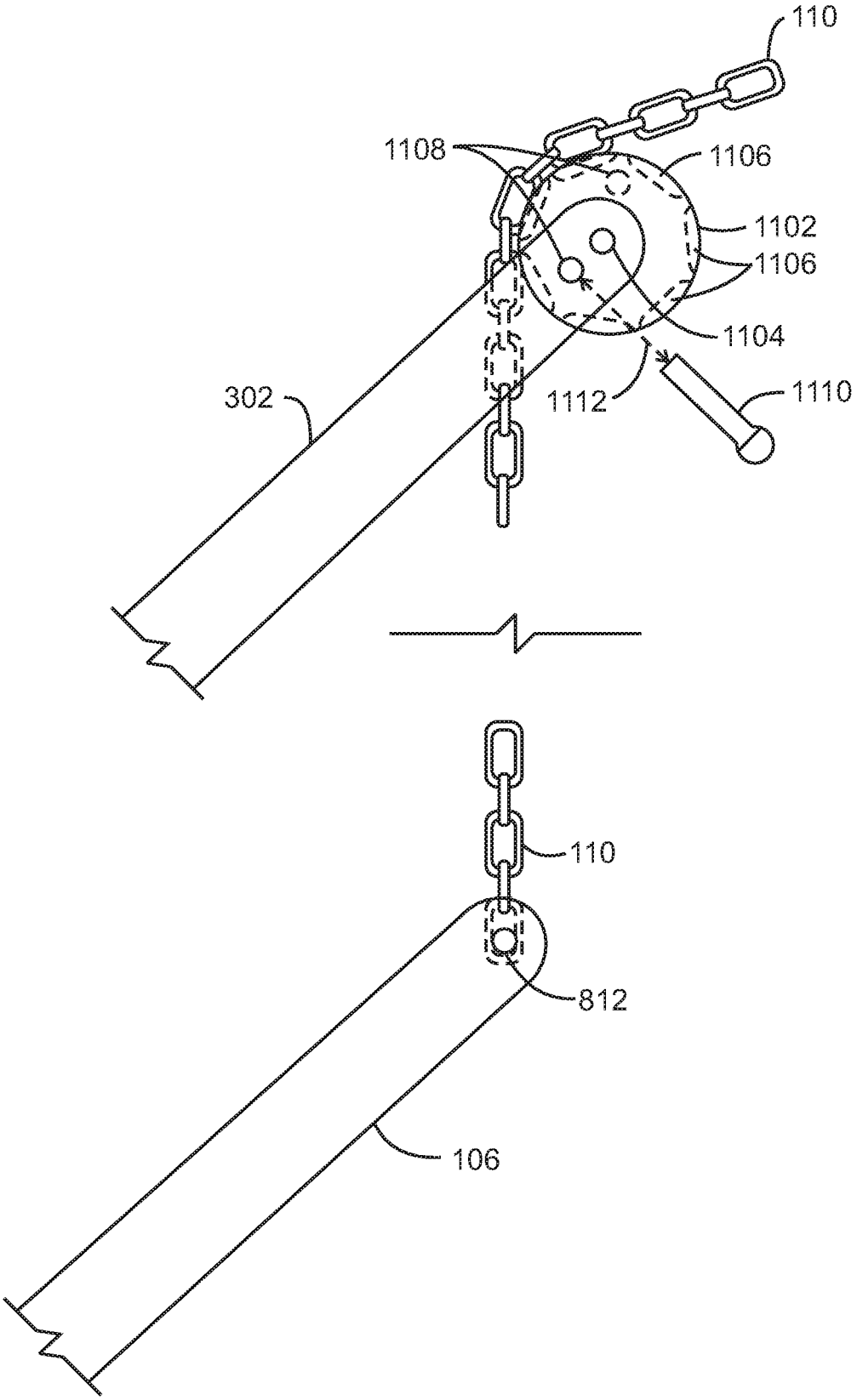
FIG. 11 is a drawing of a support bar and a padeye extender bar in an intermediate position during deployment, wherein the support bar includes a wheel to allow the mooring line to pull the support bar and the padeye extender bar into a deployed position, in accordance with examples.

FIG. 11 is a drawing of a support bar 302 and a padeye extender bar 106 in an intermediate position during deployment, wherein the support bar 302 includes a wheel 1102 to allow the mooring line 110 to pull the support bar 302 and the padeye extender bar 106 into a deployed position, in accordance with examples. Like numbered items are as described with respect to previous figures.

In this example, the wheel 1102 is mounted to the support bar 302 with an axle pin 1104. The wheel 1102 includes notches 1106 configured to engage with the mooring line 110, for example, if the mooring line 110 is an anchor chain. The wheel 1102 and the support bar 302 may include wheel locking holes 1108 configured to align, for example, when the support bar 302 is in a vertical position, a deployed position, or both. A wheel locking pin 1110 may be inserted 1112 into the aligned wheel locking holes 1108 to prevent the wheel from turning, for example, to lock the mooring line 110 in place and hold the support bar 302 in the vertical position during installation. Once the pile 104 (FIG. 1) has been installed, the wheel locking pin 1110 may be removed 1112 to allow the wheel 1102 to turn during deployment of the support bar 302 and the padeye extender bar 106. The support bar 302 and the padeye extender bar 106 may then be pulled together and locked into place, as described further with respect to FIG. 12.

Figure 12:
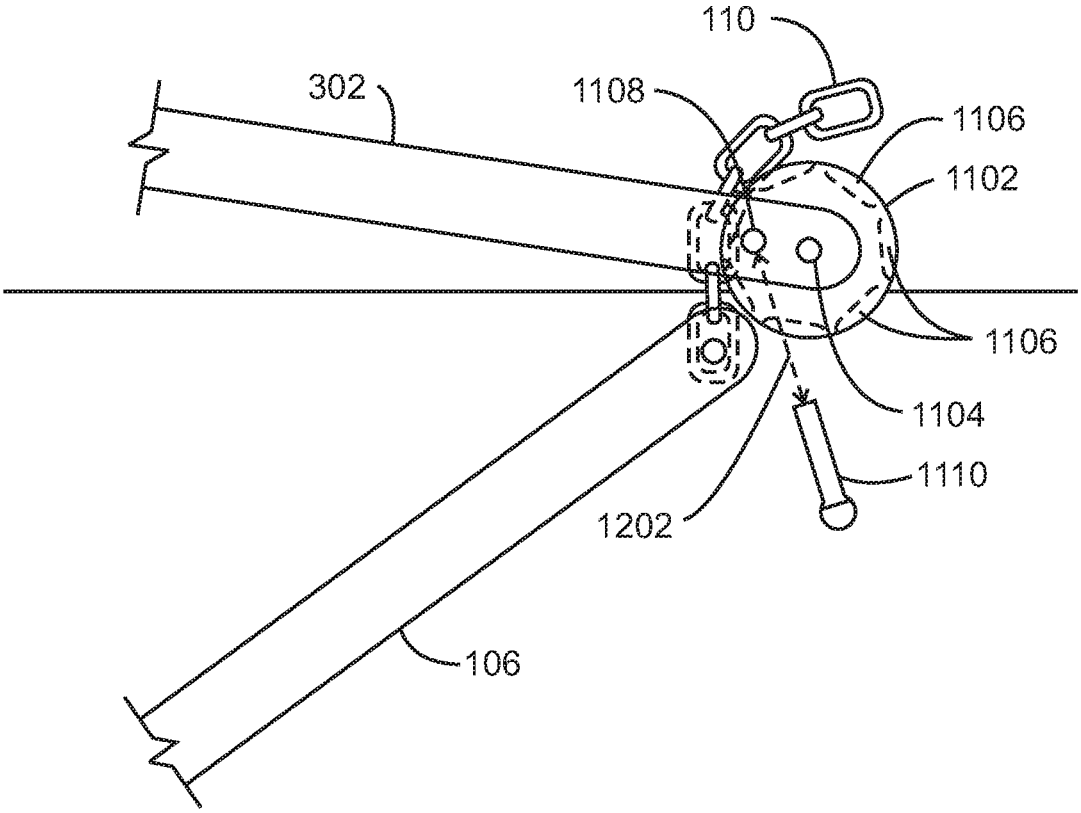
FIG. 12 is a drawing of a support bar and a padeye extender bar in a deployed position, in accordance with examples.

FIG. 12 is a drawing 1200 of a support bar 302 and a padeye extender bar 106 in a deployed position, in accordance with examples. Like numbered items are as described with respect to previous figures. In this example, once the support bar 302 and the padeye extender bar 106 are in the deployed position, the wheel locking holes 1108 in the wheel 1102 and the support bar 302 are aligned. The wheel locking pin 1110 is then inserted 1202 through the aligned wheel locking holes 1108 to prevent the wheel 1102 from turning. This holds the support bar 302 and the padeye extender bar 106 in a locked position.

Figure 13:
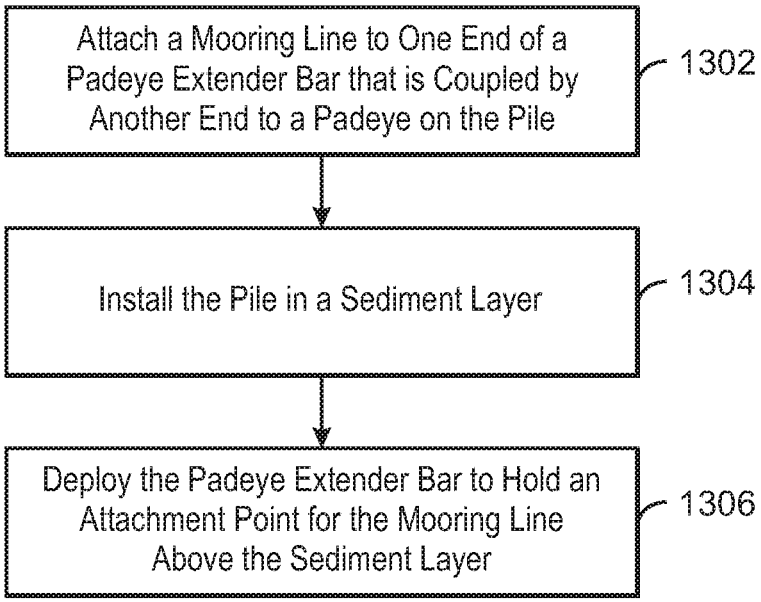
FIG. 13 is a process flow diagram of a method for reducing trenching from a mooring line, in accordance with examples.

FIG. 13 is a process flow diagram of a method 1300 for reducing trenching from a mooring line, in accordance with examples. The method 1300 begins at block 1302, when a mooring line is attached to one end of a padeye extender bar that is coupled by another in to a padeye on the pile. In some examples, the mooring line is an anchor chain with the terminal link attached to the padeye extender bar by insertion in a forked area on the padeye extender bar, with a mooring line pin inserted through the forked area and the terminal link. In another example, the mooring line is welded to the padeye extender bar. In examples where the mooring line is a woven steel line, the mooring line may be clamped to the padeye extender bar.

At block 1304, the pile may be installed in a sediment layer. In one example, the pile is a suction pile and is installed in the sediment layer by removing water from inside the suction pile to force an open end of the suction pile into the sediment layer. In another example, the pile is a driven pile that is installed by being forced into the sediment layer.

At block 1306, the padeye extender bar is deployed to hold the attachment point of the mooring line above the sediment layer. This helps to prevent movement of the mooring line, for example, from a moored structure, from generating a trench proximate to the pile.

The method 1300 is not limited to the actions in the blocks described above. For example, the padeye extender bar may be locked in place using a mechanism to prevent motion of the mooring line from moving the padeye extender bar. Further, a support bar may be attached to the pile, and deployed to contact the padeye extender bar. This may provide reinforcement to the mooring line attachment point and locking mechanism.

While the present disclosure may be susceptible to various modifications and alternative forms, the one or more examples discussed above have been shown only by way of example. However, it should again be understood that the present disclosure is not intended to be limited to the particular examples disclosed herein. Indeed, the present disclosure includes all alternatives, modifications, and equivalents falling within the true spirit and scope of the appended claims.

What is claimed is:

1. A system for reducing trenching, comprising:

a pile configured to be disposed in a sediment layer and held in place by friction with the sediment layer;

a padeye mounted to the pile;

a padeye extender bar coupled to the padeye at one end, and attached to a mooring line at an opposite end, wherein the padeye extender bar is configured to support the mooring line above a surface of the sediment layer; and a stop mounted proximate to the padeye configured to hold the padeye extender bar at an operational position.

2. The system of claim 1, wherein the pile is a suction pile or a driven pile.

3. The system of claim 1, wherein the padeye comprises a locking mechanism configured to lock the padeye extender bar in an operational position.

4. The system of claim 3, wherein the locking mechanism comprises a ratchet mechanism.

5. The system of claim 1, comprising:

a support bar padeye mounted proximate to an upper surface of the pile; and a support bar coupled to the support bar padeye, wherein the support bar is configured to deploy to the padeye extender bar and lock to the padeye extender bar.

6. The system of claim 5, wherein the support bar and the support bar padeye comprise deployment holes that are aligned when the support bar is in a vertical position and a deployment pin configured to be inserted through the aligned deployment holes to lock the support bar in the vertical position.

7. The system of claim 5, wherein the support bar and the padeye extender bar comprise locking holes configured to accept a locking pin inserted through both locking holes to lock the support bar to the padeye extender bar.

8. The system of claim 5, wherein the support bar is configured to be held in a vertical position by the mooring line during an installation.

9. The system of claim 5, wherein the support bar comprises a wheel configured to allow the mooring line to hold the support bar in contact with the padeye extender bar when tension is placed on the mooring line.

10. The system of claim 9, wherein the support bar and the wheel comprise:

wheel locking holes that align when the support bar is deployed to the padeye extender bar; and a wheel locking pin configured to be inserted through the aligned wheel locking holes to hold the support bar in a locked position with the padeye extender bar.

11. A method for reducing trenching around a pile, comprising:

attaching a mooring line to one end of a padeye extender bar that is coupled by another end to a padeye on the pile;

installing the pile in a sediment layer;

deploying the padeye extender bar to hold an attachment point for the mooring line above the sediment layer;

deploying a support bar mounted to a support bar padeye disposed proximate to a top surface of the pile; and locking the support bar to the padeye extender bar.

12. The method of claim 11, comprising locking the support bar to the padeye extender bar by inserting a locking pin through aligned locking holes on the support bar and the padeye extender bar after deployment.

13. The method of claim 11, comprising:

threading the mooring line over a wheel disposed on the support bar at an opposite end from the padeye mounting; and using the mooring line to deploy the padeye extender bar and the support bar.

14. The method of claim 13, comprising inserting a wheel locking pin through aligned wheel locking holes in the wheel and the support bar after deployment.

15. The method of claim 11, comprising:

attaching the mooring line to a support bar at an end opposite to a coupling to a support bar padeye;

installing the pile in the sediment layer; and releasing the mooring line from the support bar to deploy the support bar.

16. The method of claim 15, comprising:

deploying the support bar and the padeye extender bar; and inserting a locking pin through holes in the support bar and padeye extender bar that align when the support bar and padeye extender bar are deployed.

17. The method of claim 11, comprising:

placing a support bar in a vertical position before deployment to align deployment holes on a support bar padeye and support bar; and inserting a deployment pin through the aligned deployment holes to hold the support bar in the vertical position during deployment.

18. The method of claim 11, comprising locking the padeye extender bar in a deployed position using a ratchet mechanism.

* * * * *